US006092596A

United States Patent [19]

Van Bilderbeek

[11] Patent Number: 6,092,596

[45] Date of Patent: Jul. 25, 2000

[54] CLAMPING WELL CASINGS

[75] Inventor: Bernard Herman Van Bilderbeek, London, United Kingdom

[73] Assignee: Plexus Ocean Systems Limited, Norwich, United Kingdom

[21] Appl. No.: 09/179,056

[22] Filed: Oct. 26, 1998

[30] Foreign Application Priority Data

Oct. 24, 1997 [GB] United Kingdom ..... 9722383

[51] Int. Cl.[7] ..... E21B 23/00; E21B 33/02

[52] U.S. Cl. ..... 166/89.1; 166/96.1; 166/88.2

[58] Field of Search ..... 166/242.2, 96.1, 166/75.14, 89.1, 89.3, 88.2, 88.3, 217

[56] References Cited

U.S. PATENT DOCUMENTS

| | | | |
|---|---|---|---|
| Re. 34,071 | 9/1992 | Van Bilderbeek | 166/342 |
| 2,097,615 | 11/1937 | Burns et al. | 166/88.2 |
| 3,093,996 | 6/1963 | Jones | 73/46 |
| 3,177,703 | 4/1965 | Waters et al. | 73/40.5 R |
| 4,090,395 | 5/1978 | Dixon et al. | 73/40.5 R |
| 4,408,783 | 10/1983 | Gruller | 285/3 |
| 4,458,521 | 7/1984 | Pillette | 73/46 |
| 4,465,134 | 8/1984 | Watkins | 166/245 |
| 4,653,589 | 3/1987 | Alandy | 166/382 |
| 4,842,082 | 6/1989 | Springer | 175/279 |
| 4,982,795 | 1/1991 | King | 166/382 |
| 5,706,894 | 1/1998 | Hawkins, III | 166/208 |
| 5,735,344 | 4/1998 | Duncan | 166/75.14 |

FOREIGN PATENT DOCUMENTS

| | | |
|---|---|---|
| 621357 | 1/1961 | Canada . |
| 0 251 595 | 1/1988 | European Pat. Off. . |
| 824813 | 12/1959 | United Kingdom . |
| 1 171 201 | 11/1969 | United Kingdom . |
| 2 257 995 | 1/1993 | United Kingdom . |

OTHER PUBLICATIONS

Ringfeder brochure, Nov. 1993.

*Primary Examiner*—David Bagnell
*Assistant Examiner*—Jennifer R Dougherty
*Attorney, Agent, or Firm*—McEachran, Jambor, Keating, Bock & Kurtz

[57] ABSTRACT

A clamp for clamping two concentric tubes, typically two concentric tubes 2,4 in an oil or gas well. The clamp has two axially movable tapered components 6,7 which can be pulled over one another in an axial direction to provide a contraction of internal diameter which grips the smaller diameter tube. In one embodiment, a spacer 12 is fitted to allow the tapered components to be held apart until the tubes have been correctly positioned. The spacer is then removed, and the tapered components are drawn together to effect the clamping. A hydraulic ram 5 can be provided to separate the tapered components should readjustment be required. In another embodiment, the larger diameter tube is made with a relatively thin wall, so that it can be distorted inwards to grip the smaller tube.

24 Claims, 9 Drawing Sheets

CLAMPING WELL CASINGS

FIELD OF THE INVENTION

This invention relates to the clamping of concentric well casings, where an inner well casing is to be clamped in position relative to an outer well casing, to achieve a desired relative axial position between the casings, for operational reasons. Relative axial movement between coaxial well casings may be required at various times during drilling and/or production from wells, and the present invention makes it possible to clamp one casing within another at any desired position and subsequently to unclamp the casings, change their relative positions and then reclamp the casings in a new relative position.

BACKGROUND OF THE INVENTION

In oil and gas wells, it is conventional to pass a number of concentric tubes or casings down the well. An outermost casing is fixed in the ground, and the inner casings are each supported from the next outer casing by casing hangers which take the form of interengaging internal shoulders on the outer casing and external shoulders on the inner casing.

Such casing hangers are fixed in position on each casing. There are however applications where a fixed position casing hanger is unsatisfactory, because the hang-off point of one casing on another may require to be adjusted.

The invention has particular application to tubing hangers, especially tensioned tubing hangers.

Where drilling wellheads have to accommodate a casing with an undetermined hang-off point, it has been known to use casing slip-type support mechanisms.

It is also known from European patent number 0 251 595 to use an adjustable landing ring on a surface casing hanger to accommodate a space-out requirement when the casing is also landed in a surface wellhead.

SUMMARY OF THE INVENTION

According to a first aspect of the present invention, there is provided a clamping arrangement for clamping a tubular well casing of a first diameter within a tubular casing of larger internal diameter, the arrangement comprising a sleeve associated with the large diameter casing, the sleeve having a collar at one end which has an external tapered surface, the arrangement also including an annular component with an internal tapered surface, the sleeve and annular component being relatively axially moveable between a first position in which the tapered surface of the annular component exerts no radial force on the collar and a second position in which the tapered surface of the annular component exerts sufficient radial force to distort the collar into the bore of the larger diameter casing, to grip the well casing of smaller diameter, the arrangement also including a removable device for maintaining the surfaces in the first position, and separate means for urging the annular component axially against the collar.

The sleeve may be of one piece with the large diameter casing, but more probably will be a separate component which could either be threaded onto the casing or be located in a suitable locating and receiving area on the casing.

The clamping arrangement preferably also provides a sealing function across the interface between the tapered surfaces, either through the metal/metal contact between the tapered surfaces, or through a separate seal body. Where the sleeve is a separate component from the larger diameter casing, there may be a metal/metal seal between the tapered surfaces and, in addition, a separate seal between the sleeve and the casing.

The device for maintaining the surfaces in the first position is preferably a spacer ring. The spacer ring may be removable, or may be a ring which can be moved axially by rotating it on a thread.

The sleeve can be formed as part of a casing hanger used for supporting a casing in a well.

The annular component can be a wellhead spool, and means can be provided to move the annular component axially in a direction away from the sleeve. This means for moving can comprise a chamber between the sleeve and the annular component, and the chamber can be pressurised to urge the wellhead component away from the sleeve.

The means for urging the annular component axially against the collar can comprise radially extending bolts extending through threaded bores in the annular component and each ending in a tapered dog, and recesses around the larger diameter casing, the recesses having inclined flanks and being positioned so that when the bolts are screwed in, the dogs enter the recesses and make contact with the inclined flanks, and as the bolts are screwed further in, the annular component is drawn further towards the sleeve.

The internal bore of the larger diameter casing may have a constant internal diameter, and the sleeve can be located between the larger diameter casing and the annular component, and when the arrangement is in use, the sleeve is in abutment with the larger diameter casing.

According to a second aspect of the present invention, there is provided a clamping arrangement for clamping a tubular well casing of a first diameter within a tubular casing of larger internal diameter, wherein the larger diameter casing has a wall thickness which is sufficiently thin to allow the casing wall to be distorted inwards to grip the smaller diameter casing, the arrangement also comprising a compression unit which includes a compression collar surrounding the larger diameter casing, a compression ring axially movable relative to the collar and means for producing relative axial movement between the ring and the collar, the compression ring and compression collar having oppositely directed axially tapered annular surfaces, so that relative axial movement between the collar and ring produces a reduction in the internal diameter of the unit to distort the larger diameter casing inwards to grip the smaller diameter casing.

The tubular annular walls of oil well casings have to withstand substantial pressures, and it is this requirement to withstand certain pressures which generally determines the wall thickness of the casings. In most cases, casing walls will be too thick to allow inward deflection to grip an internal component. However by making the walls thin enough to allow such deflection, it becomes possible to achieve the advantageous clamping arrangement of the invention. It will be a matter of trial and error, or of relatively straightforward calculation, to determine the appropriate casing wall thickness for any particular application. Factors which have to be taken into account are the gap between the larger and smaller diameter casings (this gap has to be bridged when the clamp is tightened), the overall diameter of the casings and the material of which they are made.

The casing may be divided axially into different sections, and it can then be appropriate to make the section of the casing which is to be distorted inwards out of a high value/high strength material, in order to assist that section in withstanding high internal pressures and the effects of corrosion.

If it is not possible to the necessary pressure resistance whilst allowing the necessary distortion for clamping to take place, then the thin walled tube may be externally reinforced to enable it to resist the hoop stresses arising when there is a high internal pressure.

The reinforcements may take the form of annular bands around the casing section, and these bands can provide the necessary thickness of material to allow a valve or valves to be fitted to the casing in the area where the casing wall is relatively thin.

The casing section where the compression unit is located may be readily separated from the rest of the casing, so that it can be replaced when necessary.

The compression unit preferably has a compression ring which is in contact with the outer surface of the large diameter casing and a compression collar which surrounds the ring and is axially movable relative to the ring. The ring may be split at one or more points around its circumference to assist radial compression.

The ring and the collar may each have one tapered annular surface. Alternatively, and preferably, the ring has two tapered surfaces, tapering in opposite axial directions, and the collar is split into two sections with opposite axial tapers and the means for producing the relative movement acts between the two sections of the collar to move the sections in opposite directions over the ring.

Preferably the ring has its region of greatest diameter between its two ends, and the two collar sections are drawn towards one another, for example by bolts through both sections, to compress the ring and thus to clamp the larger diameter casing onto the smaller diameter casing.

The clamping arrangement described here can be used, as described, to clamp a plain walled tube. In some circumstances however (particularly for small diameter casings) it may be expedient to provide a small hanger shoulder to take a part of the casing load and/or to locate the tubular casings in a desired axial position before applying a clamping arrangement as described here to clamp the casings in position.

According to a third aspect of the invention, there is provided a clamping arrangement for clamping a tubular casing of a first diameter within a tubular casing of larger internal diameter, the arrangement comprising first and second compression rings having oppositely tapered external surfaces, an annular compression actuator having an internal tapered surface surrounding the first compression ring and an external tapered surface radially outside its internal tapered surface, and an annular component having two tapered surfaces, one of said surfaces mating with the second compression ring, and the other of said surfaces mating with the external tapered surface of the compression actuator, the compression rings, the compression actuator and the annular component having internal diameters, in the relaxed state, at least as great as the internal diameter of the larger diameter casing, and means for moving the annular component axially relative to the compression rings and the compression actuator between a first position in which the tapered surfaces of the annular component exert no radial force on the compression rings or the compression actuator and a second position in which the tapered surfaces of the annular component exert sufficient radial force to distort the compression rings into the bore of the larger diameter casing, to grip the casing of smaller diameter.

BRIEF DESCRIPTION OF THE DRAWINGS

The invention will now be further described, by way of example, with reference to the accompanying drawings, in which.

DESCRIPTION OF PREFERRED EMBODIMENTS

Figure 1:
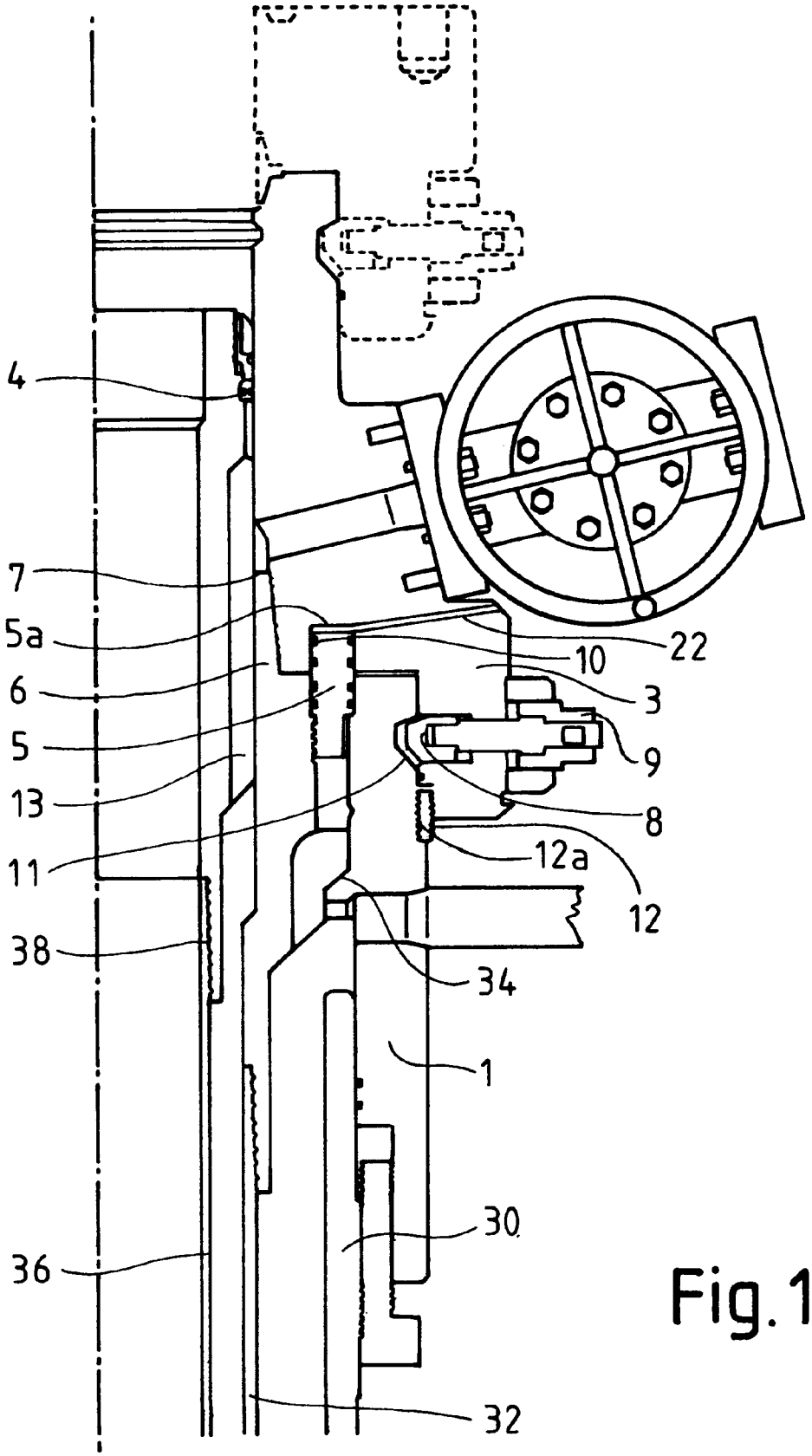
FIG. 1 shows a cross section through a surface wellhead arrangement incorporating a first embodiment of a clamping arrangement in accordance with the invention.

The adjustable wellhead shown in FIG. 1 has a surface casing starting head 1 mounted on a casing section 30. An intermediate casing 32 is located in the casing 30 and has a casing hanger 2 by means of which the casing is landed on a shoulder 34. The hanger 2 has an extended upper neck 6 which has a tapered external profile.

A wellhead spool 3 is shown above the casing hanger 2. The wellhead spool has a tapered internal profile 7 which mates with the tapered external profile of the neck 6 and, in the position shown in FIG. 1, the spool is supported above the hanger 2 on a spacer ring 12.

An annular seal ring 5 fitted with O-rings 10 provides a seal between the spool 3, the starting head 1 and the casing hanger 2.

A chamber 5*a* is present above the seal ring 5. This chamber can be pressurised, through a passage 22, to raise the spool 3 above the starting head 1, and such raising action will have the effect of unloading the weight of the wellhead spool 3 from the spacer ring 12.

The spacer ring 12 is axially movable (possibly removable) and is fitted between the starter head 1 and the spool 3, and, when present, this spacer ring controls the extent to which the spool 3 can be lowered onto the starter head 1. In one position of the spacer ring, it prevents any effective contact between the tapered surfaces 6 and 7. In another position, it does not obstruct engagement of the tapered surfaces.

The ring can be moved axially by rotating it on a thread 12*a* so that it moves up and down along the string, on the thread. Alternatively, the ring can be simply removed to remove any obstruction to engagement of the surfaces 6 and 7.

Bolts 9 (only one of which can be seen in FIG. 1), which each end in a tapered dog 8 which enters a tapered annular recess 11, allow the spool 3 to be drawn down onto the starter head 1. By screwing in the bolts, the dogs 8 bear against the tapered side wall of the recess 11 and the spool is pulled down by the camming action of the dogs. In practice, the spool will be drawn down by tightening each bolt around the string circumference, by a specified tightening extent, in turn. working around the string circumference in this way will gradually pull the tapered surfaces 6 and 7 against one another to effect a clamping action.

A production casing 36 is run into the well on an adjustable surface casing hanger 4. The casing 36 is threadedly engaged at 38 with the hanger 4. The casing is slotted at 13 for flow-by, and the hanger is positioned so that part of its length is surrounded by the extended upper neck 6 of the casing hanger 2.

During running of the casing 36, the internal diameter of the neck 6 is such that the casing hanger 4 can move axially past the neck. At this stage, the spacer ring 12 is in its first position where it prevents engagement between the surfaces 6 and 7, the extended upper neck 6 is unstressed and so the casing hanger 4 is able to move freely past the neck 6.

However when the casing hanger 4 has reached a position within the intermediate casing hanger at which it is to be clamped, the annular chamber 5*a* is pressurised to lift the wellhead 3 and to allow the spacer ring 12 to be lowered or removed. Once this has happened, the annular seal 5 is relieved of pressure and both gravity and tightening of the tapered bolts 9, results in the wellhead 3 being lowered onto the casing hanger 2 so that the tapered surfaces 6, 7 come into contact with one another. On further tightening of the bolts 9, the wedging effect of the surfaces 6 and 7 results in the extended upper neck 6 being distorted into the path of the production casing hanger 4, to a position where it grips the casing hanger which therefore becomes clamped in the well at that point.

If the position in the well of the production casing then has to be altered, for example after tensioning the production casing, then this can be done by releasing the bolts 9 and then pressurising the seal ring 5 to raise the wellhead. This relieves the wedging force acting on and distorting the extended upper neck. The neck then returns to its unstressed position where the casing hanger 4 can move freely axially past the neck.

When the casing components have taken up their new positions, for example after tensioning the production casing, then they can be clamped relative to one another by once again lowering the wellhead using the procedure described above to activate the clamp.

The bolts 9 with their clamping dogs 8 must be retracted before the wellhead can be fully lifted, and have to be fully inserted in order to apply maximum clamping force to the casing hanger 4.

Figure 2:
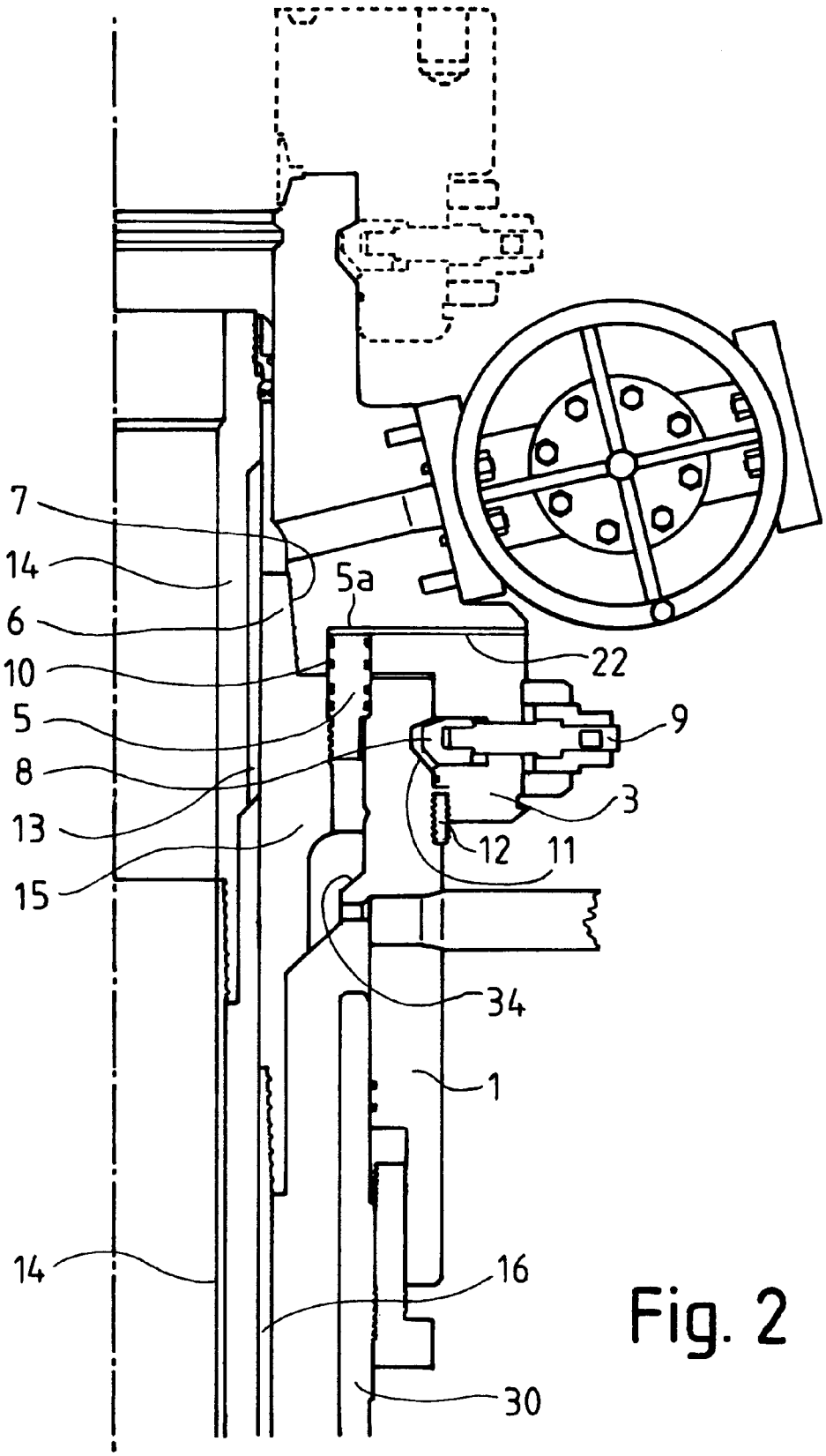
FIG. 2 shows a second embodiment of a clamping arrangement in accordance with the invention.

FIG. 2 shows a second embodiment which is largely similar to the embodiment of FIG. 1 except that the internal bore represented by the intermediate casing 16 and its casing hangar 15 now has a uniform internal diameter, so that the production casing hangar 14 can pass completely through the intermediate casing 16 and its hangar 15 when the clamp is not operated.

However, the production casing hangar 14 can be gripped and clamped in the intermediate casing 15, by a mechanism the same as that shown in FIG. 1, and corresponding parts in FIG. 2 carry the same reference numerals as they carry in FIG. 1.

Figure 3:
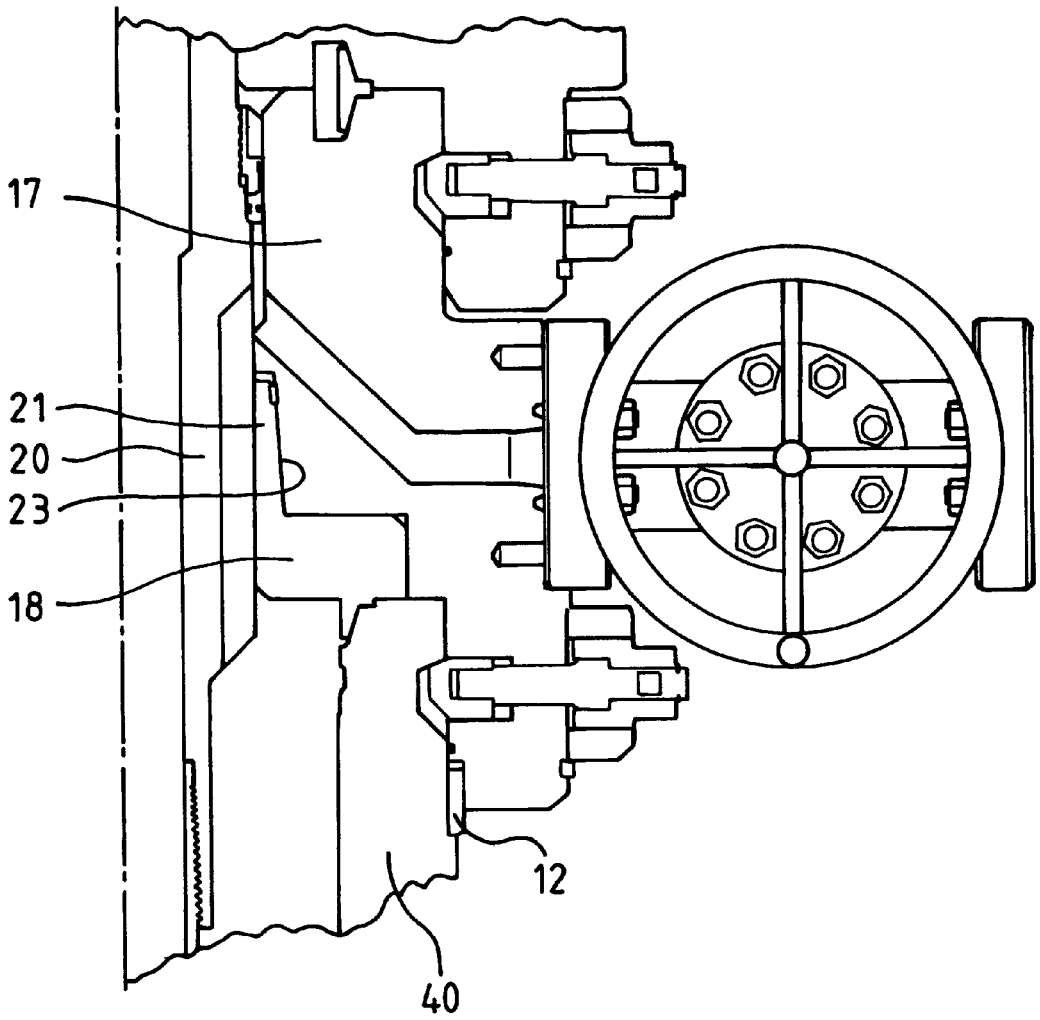
FIG. 3 shows a detail, on a larger scale, of a third embodiment of a clamping arrangement in accordance with the present invention.

FIG. 3 shows a wellhead housing 40 with a tubing head 17 installed above it. An extended upper neck 21 is formed on an annular component 18 which has an internal diameter just slightly greater than the external diameter of the tubing hanger 20. The tubing head has a tapered surface 23 which mates with the neck 21.

As described in relation to FIGS. 1 and 2, the surface of the neck 21 and the surface 23 of the tubing head 17 mate to form, when the tubing head is lowered onto the component 18, a clamp which clamps the tubing hanger 20 relative to the wellhead housing 40.

Figure 4:
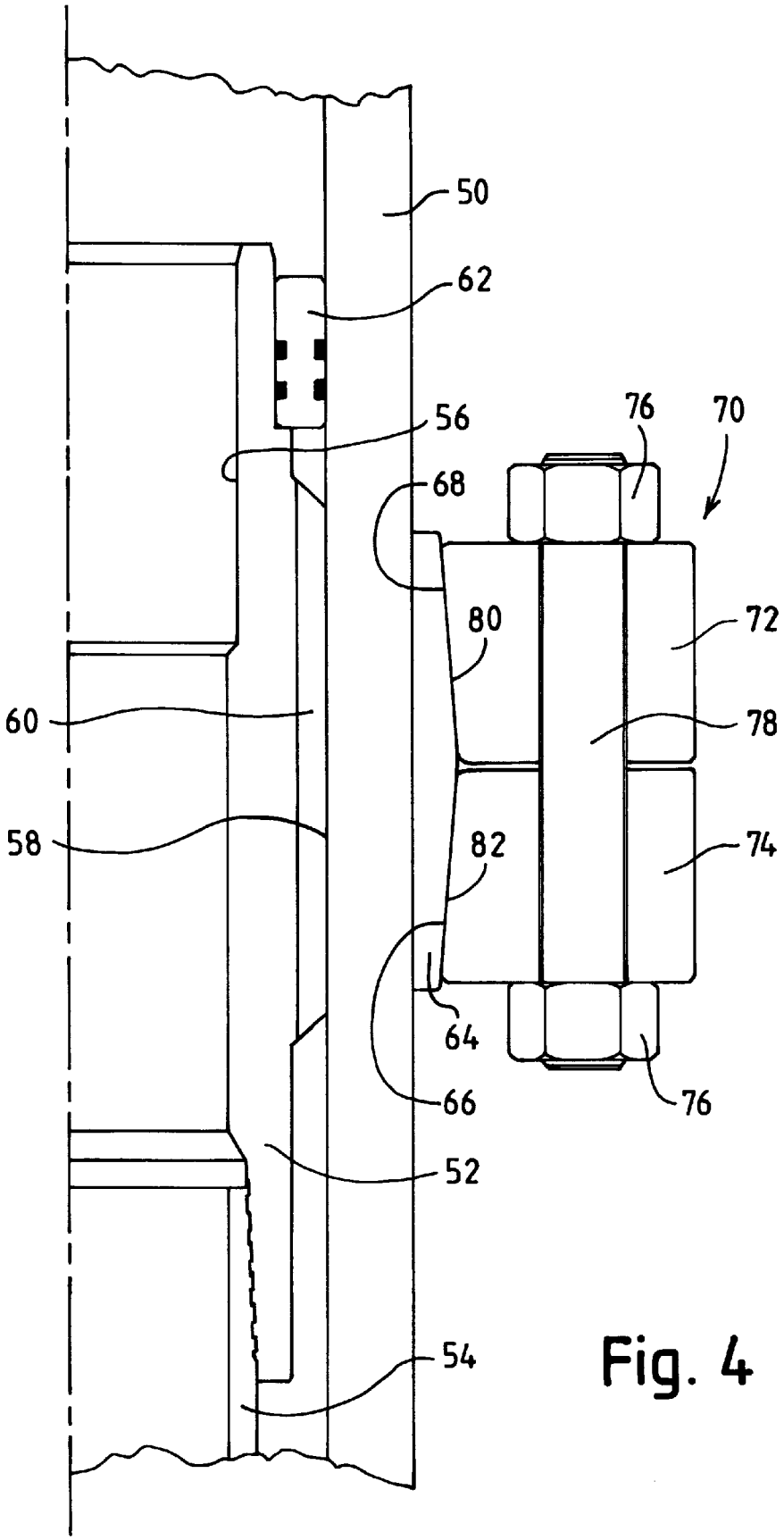
FIG. 4 shows, on a larger scale, a cross-section through a fourth embodiment of a clamping arrangement in accordance with the invention.

FIG. 4 shows a well casing tube 50 within which a casing hanger 52 is positioned. The casing hanger 52 is a close fit within the internal wall of the tube 50, and a casing 54 is suspended from the lower end of the hanger 52. At the top of the hanger 52 is a socket 56 which can be used to connect a running tool to the hanger. The outer surface of the hanger, at 58, is relieved by a flow-by passage 60, and this passage is, when necessary, closed by an annular seal 62.

On the outside surface of the casing 50, and alongside the position of the casing hanger 52, a compression ring 64 is fitted. This compression ring extends right the way around the casing 50, but will be split at one point around its circumference to allow it to be compressed and reduced in diameter. The ring 64 has two oppositely directed tapered surfaces 66, 68, and the point of greatest diameter of the ring is midway between its ends.

A compression collar 70 is made up of two collar sections 72 and 74 which can be drawn towards one another by tightening one or both of nuts 76 at opposite ends of the bolt 78. The collar sections 72 and 74 (which are each annular) have inwardly directed tapered faces 80 and 82 which match the tapered faces 66, 68 on the ring 64.

When the nuts 76 are tightened, the sections 72, 74 are drawn towards one another and they ride up the ramps 66, 68 with the result that the ring 64 is squeezed and reduced in diameter. This reduction in diameter is transmitted to the part of the casing 50 immediately within the ring 64, and the casing 50 will be compressed inwards to squeeze the casing against the outer surface 58 of the hanger 52.

It will be appreciated that there will be bolts 78 with nuts 76 arranged at regular intervals around the circumference of the compression unit 70, and to tighten the compression unit to produce clamping, it will be necessary that the bolts be tightened sequentially around the circumference until the correct clamping force has been achieved.

It will be clear that the clamping can only be effective if there is sufficient deformability within the casing tube 50. To achieve this deformation, it is likely that the tube 50 will have to be thinner than it would otherwise be. It is not however anticipated that a skilled man would find it difficult to design a tube which would have the necessary deformability for a particular application of this invention.

Instead of bolts 78 and nuts 76, it may be possible to use an alternative mechanism which draws the two collar sections 72, 74 together.

Figure 5:
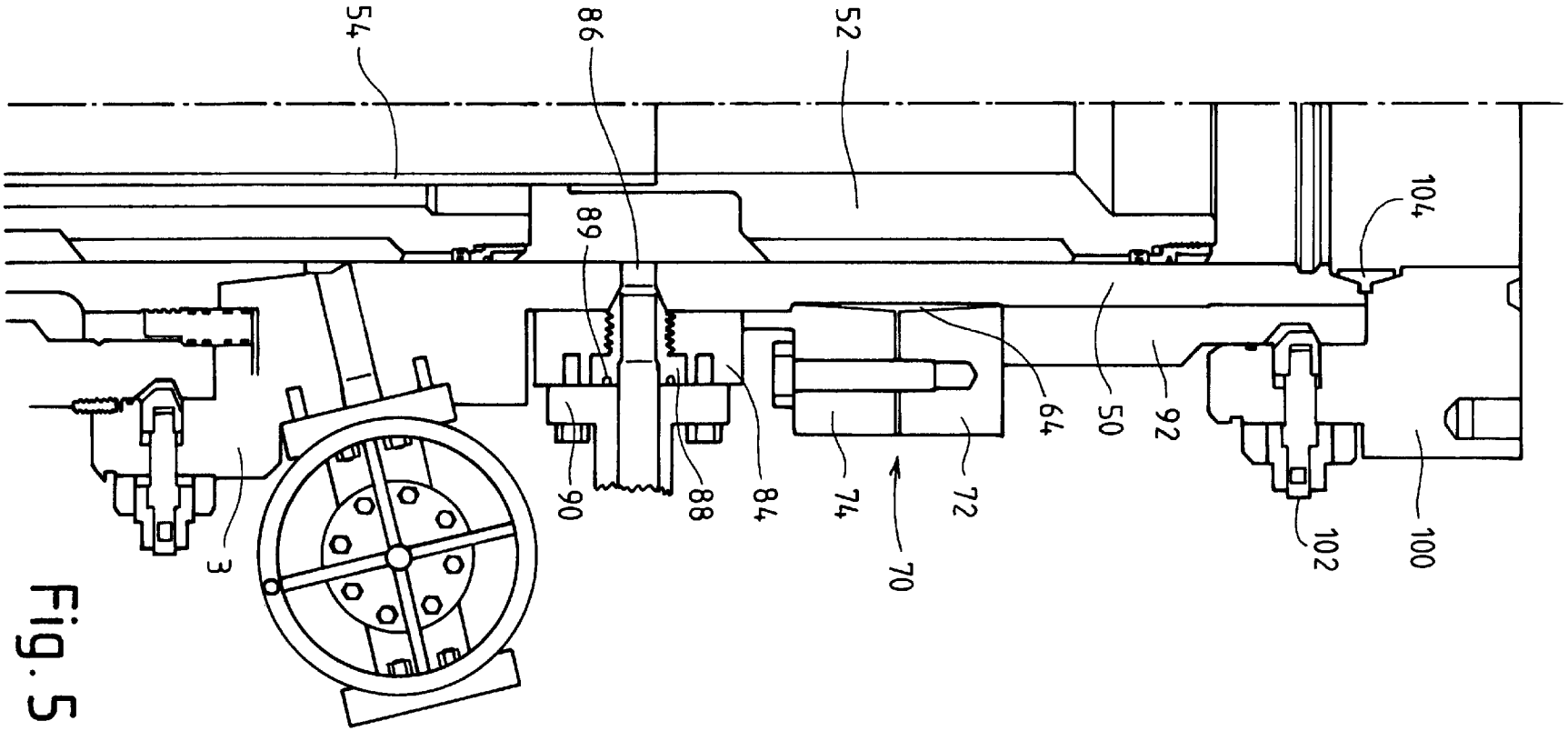
FIGS. 5 and 6 show two alternative arrangements incorporating the clamping arrangement of FIG. 4.

FIG. 5 shows the arrangement of FIG. 4, but on a smaller scale with other ancillary components also being in view.

Because the casing tube 50 is thinner than it would be expected to be (in the absence of the clamping arrangement described here) other devices are fitted around the tube, to strengthen the tube and to assist the tube in resisting hoop stresses caused by high internal pressures.

Below the pressure unit 70, there is a reinforcing ring 84 which is put in place by sliding it over the top of the casing 50. The ring 84 is annular in form to support the whole of the circumference of the tube 50.

At one or several points around the circumference of the casing tube 50 there is an outlet port 86, and the reinforcement ring 84 has a corresponding passage in which a threaded insert 88 is fitted. A valve flange 90 then is bolted onto the reinforcement ring 84. The threaded insert 88 is made up into the mouth of the opening 86, to form a metal-to-metal seal. On the side of the valve flange, the threaded insert 88 is fitted with an annular groove 89 into which a seal ring is fitted to effect a seal between the flange and the valve body.

The flange 90 will be the flange plate of a conventional valve (the valve itself is not shown here), so that when the assembly is completed, the valve can be opened or closed to open or close communication between the interior of the casing and the exterior through the passage 86.

Above the compression unit 70, there is an upper collar 92 which will be slid onto or threaded onto the external surface of the tube 50, to provide reinforcement in this upper area.

It will be seen in FIG. 5 that the casing tube 50 is part of one piece of material with the wellhead spool 3. However in FIG. 6, where the same parts carry the same reference numerals, the tube 50 is a separate component from the wellhead spool 3, with the two components being sealed to one another along a thread line 96, with the interposition of O-ring seals 98. This construction makes it possible to manufacture the deformable tube 50 from a material different from the spool 3. It also makes it possible to replace the tube part 50 independently of the spool 3. The material and manufacturing of each of these parts can therefore be optimised for the particular function and an internally damaged wellhead can be refurbished by exchanging the tube 50 only.

Figure 6:
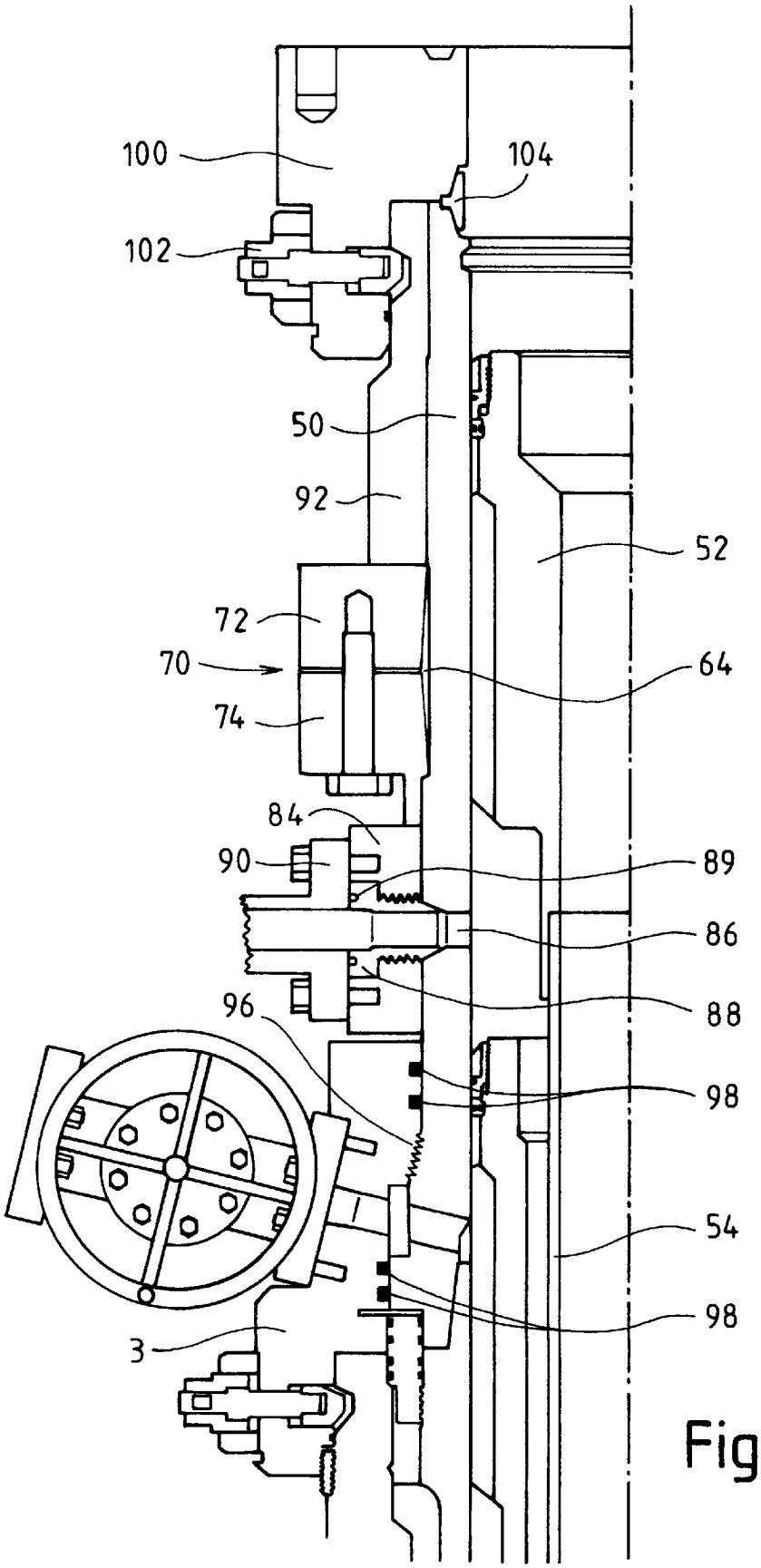

FIGS. 5 and 6 also show a drilling riser connector 100 to which a drilling riser can be connected. The connector 100 is fitted to the reinforcing ring 92 and is secured on the ring by means of axially directed dogs 102, in a manner which is in itself known. A metal sealing ring 104 provides the necessary seal.

It is of course important that the deformation of the casing tube 50 be within the elastic limit of the casing. However, as the deformation is likely to be extremely small (perhaps 5 thousandths of an inch reduction in radius) it is unlikely that any elastic limit will be approached, far less exceeded. However, the tube 50 can be relatively thin, and can be economically made of a high value material. It may need to be a material particularly resistant to corrosion, and of course it has to be capable of the small distortion necessary to achieve clamping. However because the tube is backed up around most, if not all, of its external circumference it does not need great mechanical strength. The mechanical strength can be provided by the surrounding components.

One particular advantage of the embodiment shown in FIGS. 4–6 is that there is no discontinuity in the wall of the casing, and therefore no potential leak path for the leakage of pressure.

It is thus possible to close off an annulus in an oil or gas well, with the closure and the seal being arranged at any convenient position along the length of the casing string.

Figure 7:
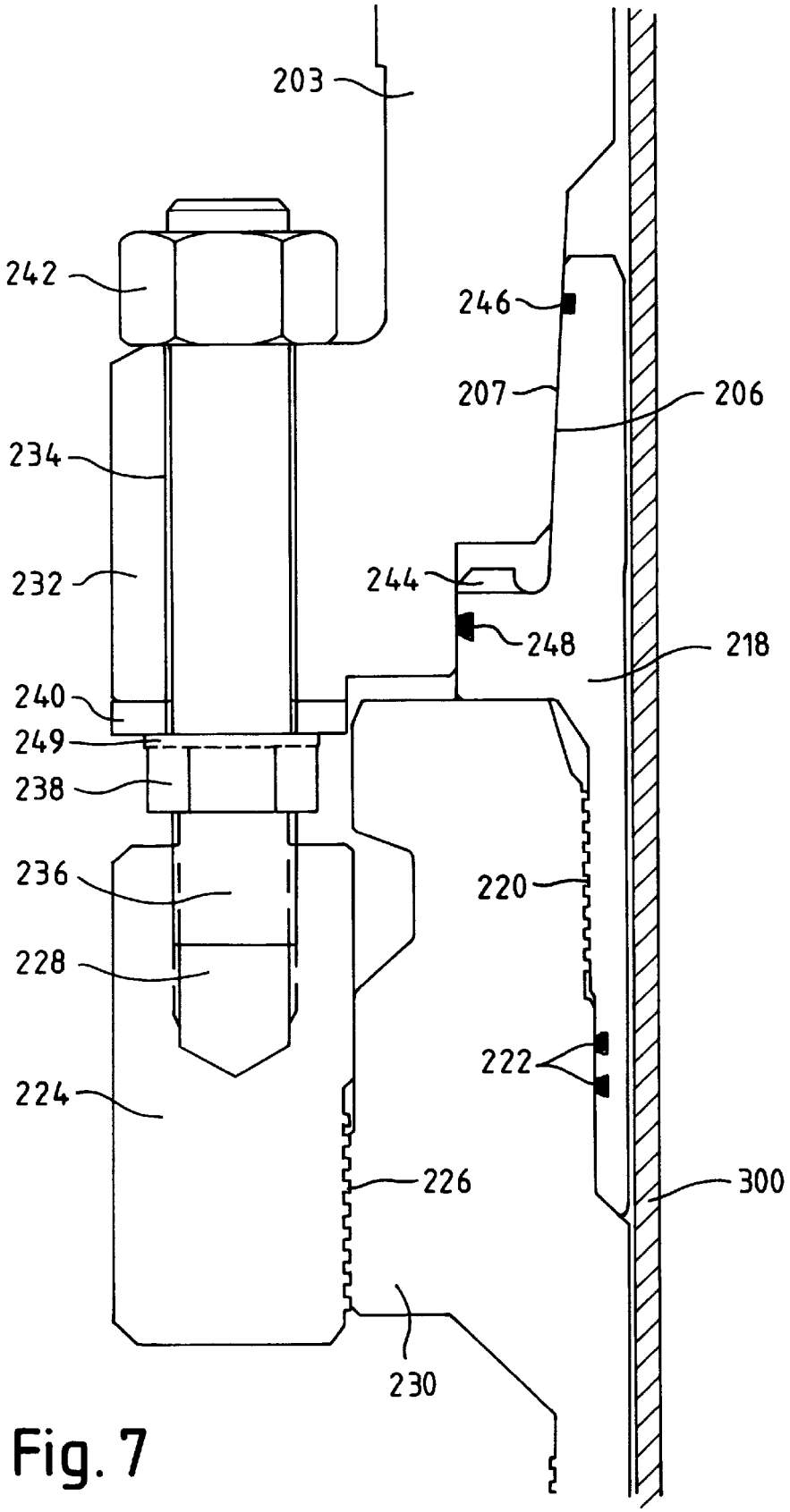
FIG. 7 shows a fifth embodiment of a clamping arrangement in accordance with the invention.
Figure 8:
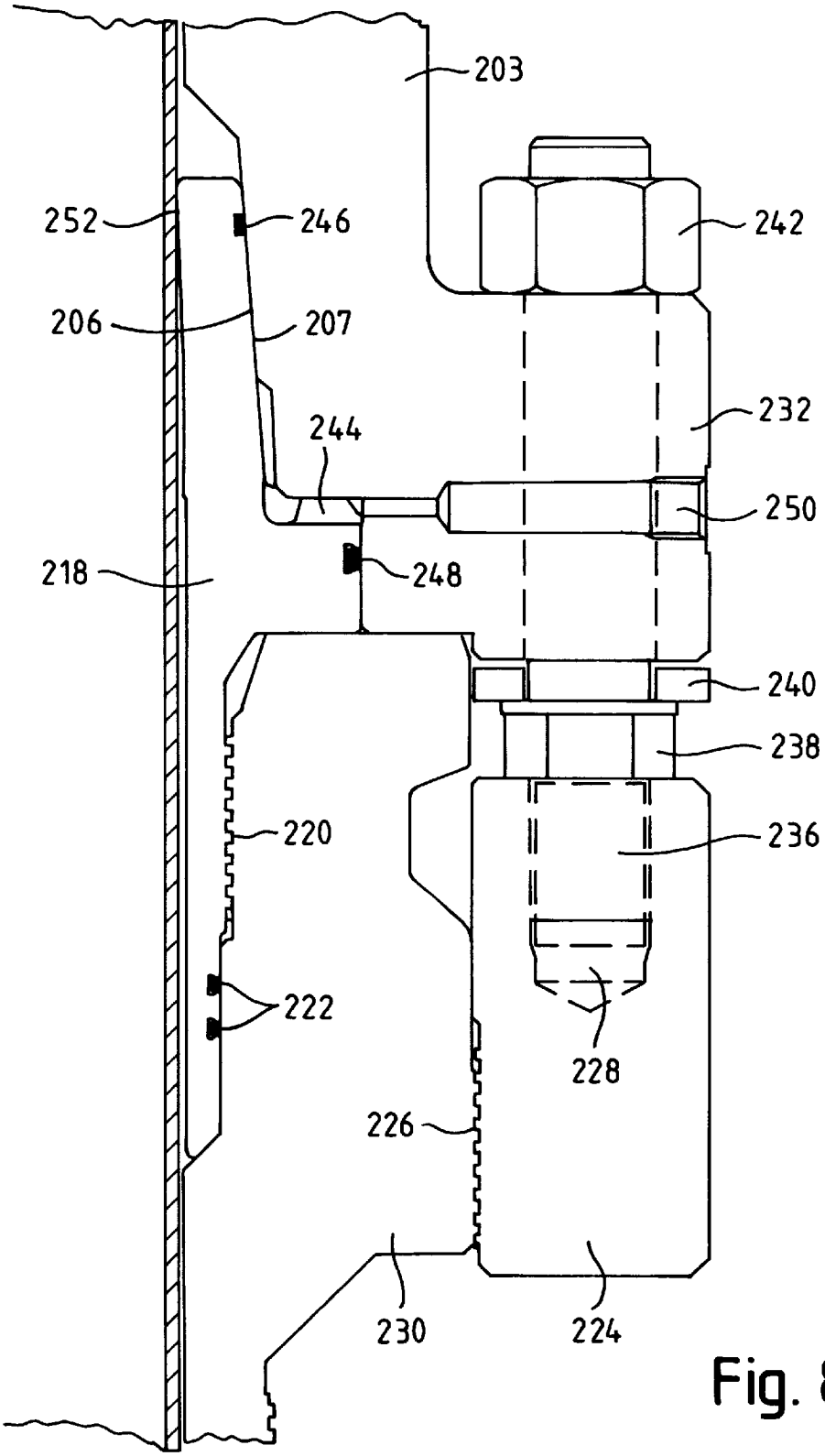
FIG. 8 shows a sixth embodiment of a clamping arrangement in accordance with the invention.

FIGS. 7 and 8 show clamping arrangements in which the clamping load can be accurately controlled. FIG. 7 shows two adjacent casing sections 203 and 230. The upper casing section 203 has a tapered internal profile 207 which mates with a tapered external profile 206 of a clamp component 218. The component 218 is threaded to the lower casing section 230 at 220, and seals 222 provide the necessary sealing function.

Around the exterior of the casing section 230, an anchoring ring 224 is fitted, the ring being connected to, and adjustable relative to, the casing section on a thread 226. The ring 224 has a series of threaded bores 228 arranged around the circumference. only one of these bores is visible in the figure.

The upper casing section 203 has a shoulder 232 which has a series of through bores 234 each of which registers with one of the threaded blind bores 228 in the ring 224. Threaded studs 236 are fitted in each of the bores.

Each stud 236 has a lower end which screws into one of the blind bores 228. A nut 238 is threaded onto the stud, and a thrust plate 240 with a washer 249 lies above the nut. The upper casing section 203 is then placed over the upstanding part of the stud, and a further nut 242 is threaded onto the top of the stud.

In use, the nuts 242 can be tightened to draw the casing section 203 and its tapered surface 207 down onto the tapered surface 206 of the clamp component 218, to clamp a tube 300. It will be seen from FIG. 7 that the positions of the nuts 238 determine the extent to which the tapered surface 207 of the casing section 203 can be drawn down onto the tapered section 206 of the clamp component 218, and thus determines the clamping force which can be applied to the tube 300. However the positions of the nuts 238 relative to the lower casing section 230 can be altered by turning the nuts on the threads of the studs 236.

The nuts 238 can also be used to release the clamp. To do this, the upper nuts 242 are slackened off, and a tool is used to turn the nuts 238 so that they lift the upper casing section 203 to reduce the engagement between the surfaces 206 and 207. The presence of the thrust plate 240 and washers 249 makes it possible to turn the nuts 238 when they are under load.

FIG. 7 also shows a fixed end stop 244, which provides the ultimate limit to relative axial movement between the tapered surfaces, and annular seals 246 and 248 between the separate clamp component 218 and the upper casing section 203.

FIG. 8 shows the arrangement of FIG. 7, but with the clamp fully tightened up to the stop 244. It will be seen that there is clamping contact between the component 218 and the casing 300 at 252. The view shown in FIG. 8 is taken at a different point around the casing circumference, and shows a monitoring port 250 which communicates with the gap between the clamp component 218 and the upper casing section 203.

Figure 9:
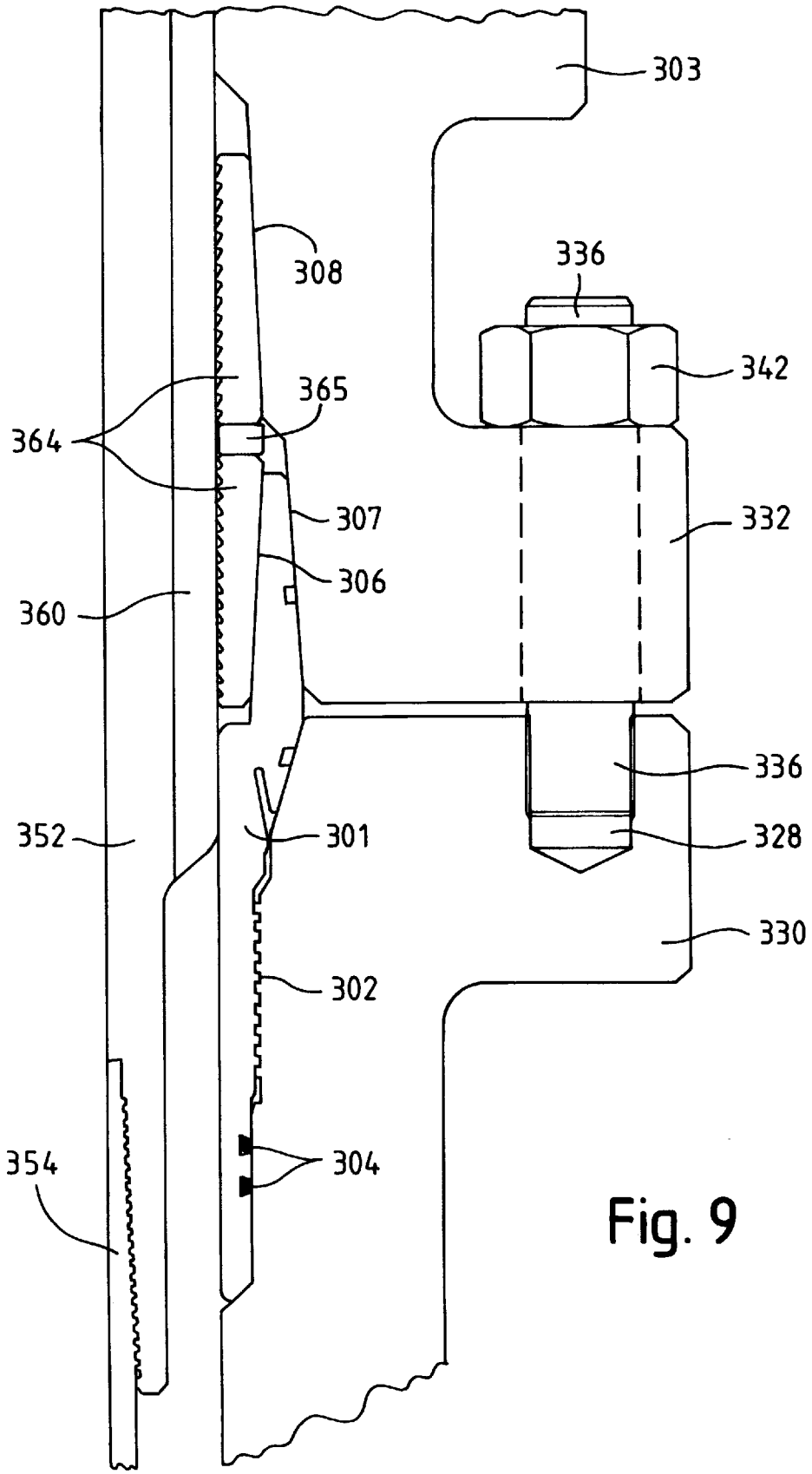
FIG. 9 shows a seventh embodiment of a clamping arrangement in accordance with the invention.

FIG. 9 shows an embodiment which combines features from earlier described embodiments.

In FIG. 9, a casing hanger 352 is to be clamped within an upper casing section 303 and a lower casing section 330. The hanger 352 has a flow-by passage 360, and has a casing 354 threaded to its lower end.

Threaded studs 336 are fitted in each of the bores on shoulder 332. Each stud 336 has a lower end that screws into one of the blind bores 228.

Two compression rings 364 (each similar to one half of the ring 64 of FIG. 4) separated by a plain ring 365 are retained within a correspondingly shaped annular, internal recess formed by the upper and lower section 303, 330. Also within this recess is an annular sleeve 301. The sleeve 301 is threaded at 302 onto a corresponding internal thread on the section 330. Seals 304 are provided to seal between the sleeve and the section 330.

The sleeve 301 has an upper region which has both an internally tapered surface 306 and an externally tapered surface. The upper section 303 has an upper internally tapered surface 308 and a lower internally tapered surface 307.

When the components are assembled as shown in FIG. 9, tightening of the nuts 342 (of which there will be several around the circumference) draws the upper section 303 towards the lower section 330. This will cause all the tapering surfaces to ride over one another.

The surface 308 of the upper section 303 will ride over the upper compression ring 364 and will compress the ring inwardly.

The surface 307 of the upper section 303 will ride over the upper part of the sleeve 301 and will compress the sleeve inwardly.

At the same time, the upper part of the sleeve 301 will be driven into the tapering gap between the lower one of the compression rings 364 and the upper section 303, and this will cause the lower compression ring to be compressed radially inwards, to grip the casing hanger 352, at whatever part of the hanger lies within the circumference of the rings 364.

In this embodiment, metal/metal seals exist between the surfaces of the upper and lower sections, the compression rings 364 and the sleeve 301. The surfaces of the compression rings which will make contact with the hanger 352 can be ribbed or serrated, in order to enhance the grip of the rings on the hanger. The compression ring could be made from a single component with two oppositely tapered surfaces, instead of the construction described above.

The clamping/clamping system described here is easy and simple to operate and allows the parts of the clamp to be held apart, against gravitational influences, until the components to be clamped are in their correct relative positions. It also allows the clamp to be easily opened and closed to allow adjustment of relative axial positions.

What is claimed is:

1. A clamping arrangement for clamping a tubular casing of a first diameter within a tubular casing of larger internal diameter, the arrangement comprising a sleeve forming part of or connected to the larger diameter casing, a collar at one end of the sleeve, which collar has an external tapered surface, an annular component with an internal tapered surface, means for producing relative axial movement between the sleeve and annular component between a first position in which the tapered surface of the annular component exerts no radial force on the collar and a second position in which the tapered surface of the annular component exerts sufficient radial force to distort the collar into the bore of the larger diameter casing, to grip the casing of smaller diameter, a device for maintaining the surfaces in the first position, and separate means for urging the annular component axially against the collar.

2. An arrangement as claimed in claim 1, wherein the device for maintaining the surfaces in the first position is a spacer ring.

3. An arrangement as claimed in claim 2, wherein the spacer ring is axially movable by rotating it on a thread.

4. An arrangement as claimed in claim 2, wherein the spacer ring is removable.

5. An arrangement as claimed in claim 1, wherein the sleeve forms a casing hanger for supporting a casing in a well.

6. An arrangement as claimed in claim 1, wherein the annular component is a wellhead spool.

7. An arrangement as claimed in claim 1, wherein means are provided to move the annular component axially in a direction away from the sleeve.

8. An arrangement as claimed in claim 7, wherein the means for moving comprises an hydraulically extendable annular ram.

9. An arrangement as claimed in claim 8, wherein the ram acts as a seal between the sleeve and the annular component.

10. An arrangement as claimed in claim 1, wherein the longitudinal axis of the clamping arrangement is vertical.

11. An arrangement as claimed in claim 1, wherein the means for urging the annular component axially against the collar comprises radially extending bolts extending through threaded bores in the annular component and each ending in a tapered dog, and recesses around the larger diameter casing, the recesses having inclined flanks and being positioned so that when the bolts are screwed in, the dogs enter the recesses and make contact with the inclined flanks, and as the bolts are screwed further in, the annular component is drawn further towards the sleeve.

12. An arrangement as claimed in claim 1, wherein the internal bore of the larger diameter casing has a constant internal diameter.

13. An arrangement as claimed in claim 1, wherein the sleeve is located between the larger diameter casing and the annular component, and when the arrangement is in use, the sleeve is in abutment with the larger diameter casing.

14. A clamping arrangement for clamping a tubular well casing of a first diameter within a tubular casing of larger internal diameter, the arrangement comprising a larger diameter casing which has thin walls to allow the casing wall to be distorted inwards to grip the smaller diameter casing, a compression unit which includes a compression collar surrounding the larger diameter casing, a compression ring axially movable relative to the collar, and means for producing relative axial movement between the ring and the collar, the compression ring and compression collar having oppositely directed axially tapered annular surfaces, so that relative axial movement between the collar and ring produces a reduction in the internal diameter of the unit to distort the larger diameter casing inwards to grip the smaller diameter casing.

15. A clamping arrangement as claimed in claim 14, wherein the larger diameter casing is divided axially into different sections, and the section of the casing which is to be distorted inwards out is made from of a high value/high strength material (as compared with the rest of the casing), in order to assist that section in withstanding high internal pressures.

16. A clamping arrangement as claimed in claim 14, wherein the thin walled tube is externally reinforced to enable it to resist the hoop stresses arising when there is a high internal pressure.

17. A clamping arrangement as claimed in claim 16, wherein the reinforcements take the form of annular bands around the larger diameter casing.

18. A clamping arrangement as claimed in claim 17, wherein the reinforcing bands provide a seat for a valve to be fitted to the larger diameter casing in the area where the larger diameter casing wall is relatively thin.

19. A clamping arrangement as claimed in claim 14, wherein the area of the larger diameter casing section where the compression unit is located may be readily separated from the rest of the casing, so that it can be replaced when necessary.

20. A clamping arrangement as claimed in claim 14, wherein the compression unit has a compression ring which is in contact with the outer surface of the large diameter casing and a compression collar which surrounds the ring and is axially movable relative to the ring.

21. A clamping arrangement as claimed in claim 20, wherein the ring is split at one or more points around its circumference to assist radial compression.

22. A clamping arrangement as claimed in claim 20, wherein the ring has two tapered surfaces, tapering in opposite axial directions, the collar is split into two sections with opposite axial tapers and the means for producing the relative movement acts between the two sections of the collar to move the sections in opposite directions over the ring.

23. A clamping arrangement as claimed in claim 22, wherein the ring has its region of greatest diameter between its two ends, and the two collar sections are drawn towards one another to compress the ring and thus to clamp the larger diameter casing onto the smaller diameter casing.

24. A clamping arrangement for clamping a tubular casing of a first diameter within a tubular casing of larger internal diameter, the arrangement comprising first and second compression rings having oppositely tapered external surfaces, an annular compression actuator having an internal tapered surface surrounding the first compression ring and an external tapered surface radially outside its internal tapered surface, and an annular component having two tapered surfaces, one of said surfaces mating with the second compression ring, and the other of said surfaces mating with the external tapered surface of the compression actuator, the compression rings, the compression actuator and the annular component having internal diameters, in the relaxed state, at least as great as the internal diameter of the larger diameter casing, and means for moving the annular component axially relative to the compression rings and the compression actuator between a first position in which the tapered surfaces of the annular component exert no radial force on the compression rings or the compression actuator and a second position in which the tapered surfaces of the annular component exert sufficient radial force to distort the compression rings into the bore of the larger diameter casing, to grip the casing of smaller diameter.

* * * * *

UNITED STATES PATENT AND TRADEMARK OFFICE

CERTIFICATE OF CORRECTION

PATENT NO. : 6,092,596
DATED : July 25, 2000
INVENTOR(S) : Bernard Herman Van Bilderbeek It is certified that error appears in the above-identified patent and that said Letters Patent is hereby corrected as shown below:

Fig. 1, insert the numeral – 2—as shown on the attached page.
Fig. 8, insert the numeral –300—as shown on the attached page.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,092,596
DATED : July 25, 2000
INVENTOR(S) : Bernard Herman Van Bilderbeek It is certified that error appears in the above-identified patent and that said Letters Patent is hereby corrected as shown below:

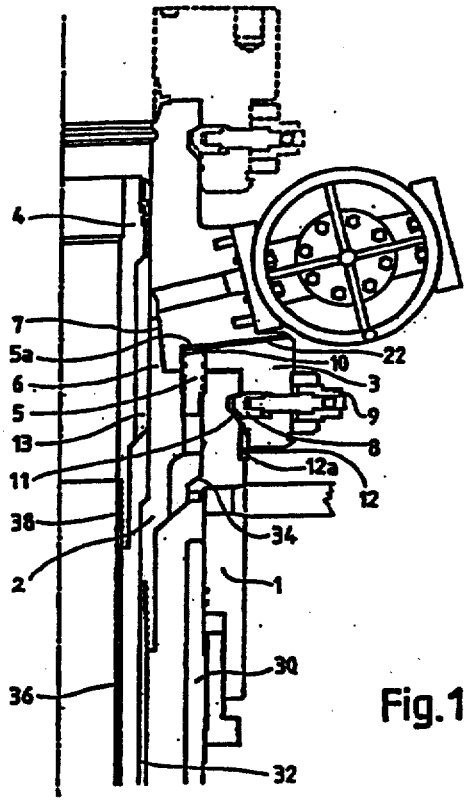

Fig.1

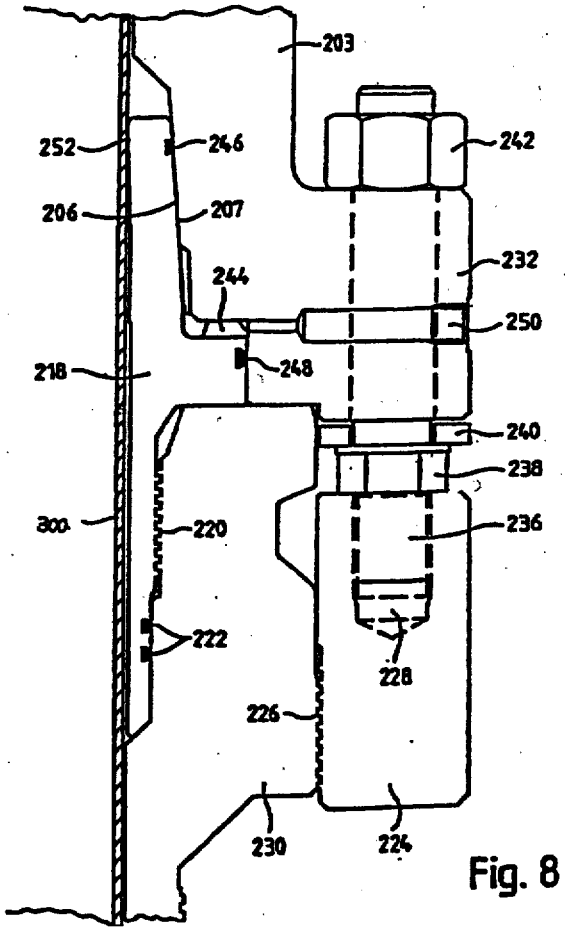

Fig. 8